US007575097B2

(12) United States Patent
Sheridan et al.

(10) Patent No.: US 7,575,097 B2
(45) Date of Patent: Aug. 18, 2009

(54) LADDER ATTACHMENT

(76) Inventors: Vincent J. Sheridan, 6465 Sheridan Line, Croswell, MI (US) 48422; Christopher J. Schienke, 7311 School Rd., Melvin, MI (US) 48454

( * ) Notice: Subject to any disclaimer, the term of this patent is extended or adjusted under 35 U.S.C. 154(b) by 347 days.

(21) Appl. No.: 11/458,788

(22) Filed: Jul. 20, 2006

(65) Prior Publication Data

US 2008/0017447 A1 Jan. 24, 2008

(51) Int. Cl.
*E06C 7/00* (2006.01)

(52) U.S. Cl. ..... 182/206; 182/107

(58) Field of Classification Search ..... 182/93, 182/107, 206; 248/222.11, 222.12, 219.4, 248/230.8

See application file for complete search history.

(56) References Cited

U.S. PATENT DOCUMENTS

| | | | | | |
|---|---|---|---|---|---|
| 2,806,975 | A | | 10/1957 | Palmquist | |
| 2,870,948 | A | | 1/1959 | Lundgren | |
| 2,925,877 | A | | 2/1960 | Wright | |
| 3,022,898 | A | * | 2/1962 | Loeb | 211/64 |
| 3,028,929 | A | | 4/1962 | Chubbs | |
| 3,037,579 | A | | 6/1962 | Barrow | |
| 3,062,319 | A | * | 11/1962 | Wright | 182/108 |
| 3,096,960 | A | * | 7/1963 | Kinney | 248/113 |
| 3,318,415 | A | | 5/1967 | Christie, Sr. | |
| 3,336,999 | A | | 8/1967 | McSwain | |
| 3,715,012 | A | | 2/1973 | Perry | |
| 3,792,756 | A | | 2/1974 | Kelly | |
| 3,828,889 | A | | 8/1974 | Rehm | |
| 4,379,498 | A | | 4/1983 | Krusmark | |
| 4,469,194 | A | | 9/1984 | McBride | |
| 4,469,195 | A | | 9/1984 | Sartain | |
| D276,467 | S | * | 11/1984 | Singer | D25/64 |
| 4,580,661 | A | * | 4/1986 | Thomson, Jr. | 182/107 |
| 4,593,790 | A | | 6/1986 | Brewer et al. | |
| 4,946,004 | A | | 8/1990 | Henson | |
| 5,323,875 | A | | 6/1994 | Kennett | |
| 5,622,238 | A | * | 4/1997 | Farmer | 182/214 |
| 5,638,916 | A | | 6/1997 | Schneider | |
| D388,883 | S | * | 1/1998 | Thivierge et al. | D25/68 |
| 6,250,424 | B1 | | 6/2001 | Laug | |
| 6,354,400 | B1 | | 3/2002 | Purkayastha | |
| 6,691,825 | B2 | | 2/2004 | Haig | |
| 6,698,546 | B1 | | 3/2004 | Sandor, Sr. | |
| 6,729,441 | B1 | * | 5/2004 | Nahlen | 182/206 |
| 6,851,518 | B1 | | 2/2005 | Walker | |
| 2002/0108811 | A1 | * | 8/2002 | Ulmschneider et al. | 182/206 |

FOREIGN PATENT DOCUMENTS

| | | | |
|---|---|---|---|
| GB | 2207453 | A * | 2/1989 |

* cited by examiner

*Primary Examiner*—Alvin C Chin-Shue
(74) *Attorney, Agent, or Firm*—John R. Benefiel

(57) ABSTRACT

A ladder attachment including an elongated one piece member preferably molded from an elastomeric material and formed with an arcuate cavity on one side sized to approximately correspond to the outside of a utility pole or tree trunk and having a pair of end parts each formed with a hole sized to receive the upper end of a ladder stile to be mountable crosswise to the upper end of the ladder. A pair of curved slits are formed into the one side of the member each extending around one side of the cavity to form a pair of concentric curved gripper wing portions concentric to the cavity which are drawn together with a strap, which has ends connected together with a cinch to secure the ends together.

10 Claims, 3 Drawing Sheets

LADDER ATTACHMENT

BACKGROUND OF THE INVENTION

This invention concerns ladders and more particularly attachments for stabilizing lean type ladders to prevent the ladder from tipping or sliding when propped up against a supporting structure. Attachments have been developed in particular for stabilizing lean type ladders when supported against flat surfaces or against the trunks of trees and utility poles which do not present a flat surface for engaging the upper ends of the ladder stiles.

Various complex and costly ladder attachments have been developed which have not heretofore come into widespread use.

It is the object of the present invention to provide a simple low cost ladder attachment which is very effective for stabilizing lean type ladders when propped against flat surfaces or against rounded or irregularly shaped narrow supports such as utility poles and tree trunks.

SUMMARY OF THE INVENTION

The above recited object as well as other objects which will become apparent upon a reading of the following specification and claims are achieved by an elongated one piece member, preferably molded from an elastomeric material which is relatively stiff and which has an arcuate cavity recessed into one side of the member intermediate two end parts. Each end part has a hole extending crosswise and vertically through the member adapted to slidably receive the upper end of a ladder stile to be mounted to the upper end of the ladder, leaving each end part projecting to one side of the ladder. Serrations may be formed on a side of each hole to grip a stile when inserted therein to effectively resist pull out after installation on the stiles.

Vertical grooves or ribs are formed on a forward flat face of each of the member end parts to enhance frictional engagement with a flat support surface. The outboard location of the widely spaced end parts and the ribbed face stabilizes the ladder when leaning against a flat surface by preventing slipping or twisting of the ladder.

Integrally formed in the member are a pair of curved gripper wing portions each on one side of the cavity and partially defining the cavity. The wing portions are formed by curved slits extending into the one side of the member spaced a short distance in from the arcuate cavity sides and following along each side of the cavity terminating at the base of the wing portion to have an integral connection at one end to the member. The other end of each wing portion is free to be able to be moved in towards the other gripper wing portion. The exposed face of each gripper wing portion preferably has vertical ridges or steps for enhanced gripping of a pole or tree trunk. Since each curved gripper wing portion is free at its outer end this allows the wing portions to be pulled towards each other to tightly grip a pole or tree trunk.

The integral connection to the member allows each gripper wing portion to be resiliently bendable towards each other but moving apart when released.

A strap enables the gripper wing portions to be pulled together and held in position against a supporting pole with a tight fit achieved over a range of utility pole or tree trunk diameters and to irregularly shaped tree trunks. The gripper wing portions are resiliently deformable to also be conformable to the outer surface of the pole or tree trunk.

The member end parts can each also have round and/or irregularly shaped openings formed therein for holding tools such as hammers, screw drivers and other tools and objects. Hooks are molded or otherwise formed into the member to provide a hanging support for paint cans and similar items.

DETAILED DESCRIPTION

Figures 1, 1A:
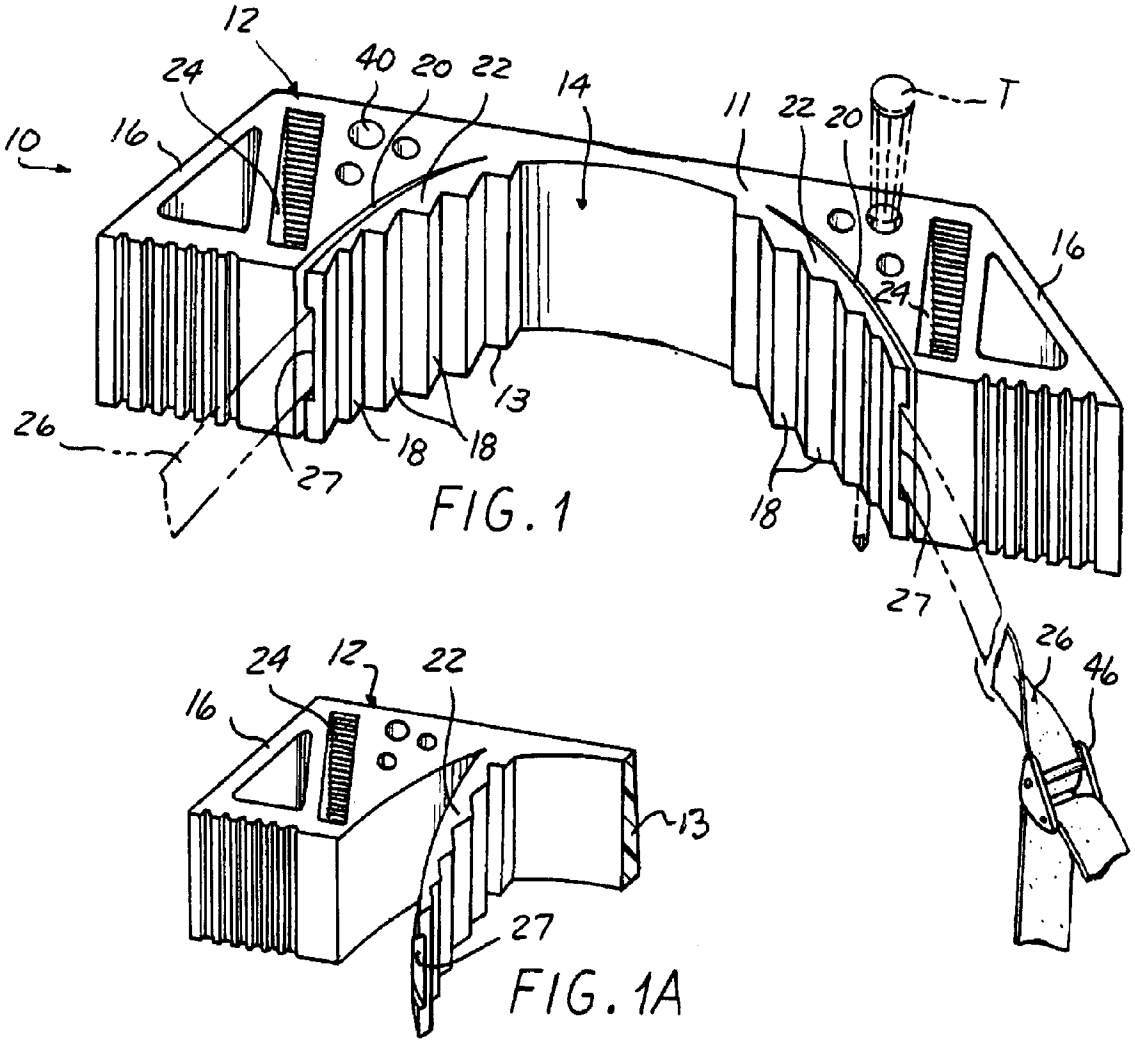
FIG. 1 is a pictorial view of a ladder attachment according to the present invention.
FIG. 1A is a fragmentary pictorial view of one end of the ladder attachment shown in FIG. 1 with a gripper wing portion in a drawn in condition.

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Referring to the drawings, the attachment 10 includes a one piece elongated member 12 preferably molded from a moldable material such as hard rubber, plastic or an elastomer material such as urethane, silicone, PVC or similar polmeric resins. Hard rubber or urethane are preferred materials Other material can be used such as wood, metal, etc., but this may require more costly forming or machining steps.

The member 12 is generally elongated and stiff to not be easily bent so as to resist excessive deflection when loaded as by the weight of a person on the ladder with the member supporting the upper end of the ladder leaning against a support. The member 12 is formed with an arcuate cavity 14 recessed into one side of the member 12 with a pair of integral end parts 16 located on either side of the cavity 14. The cavity 14 is sized to be approximately matched to the outer contour of utility poles, tree trunks, etc., i.e., an approximate radius on the order of 15 inches.

A series of vertical steps 18 line the interior of the cavity 14 in the outer regions thereof to create frictional gripping features. The wall 13 defining cavity 14 including the steps 18 can be tapered out from top to bottom to better match the slope of a leaned ladder when in a correctly angled position against a utility pole P, or tree trunk T as seen in FIG. 1A.

Figure 2:
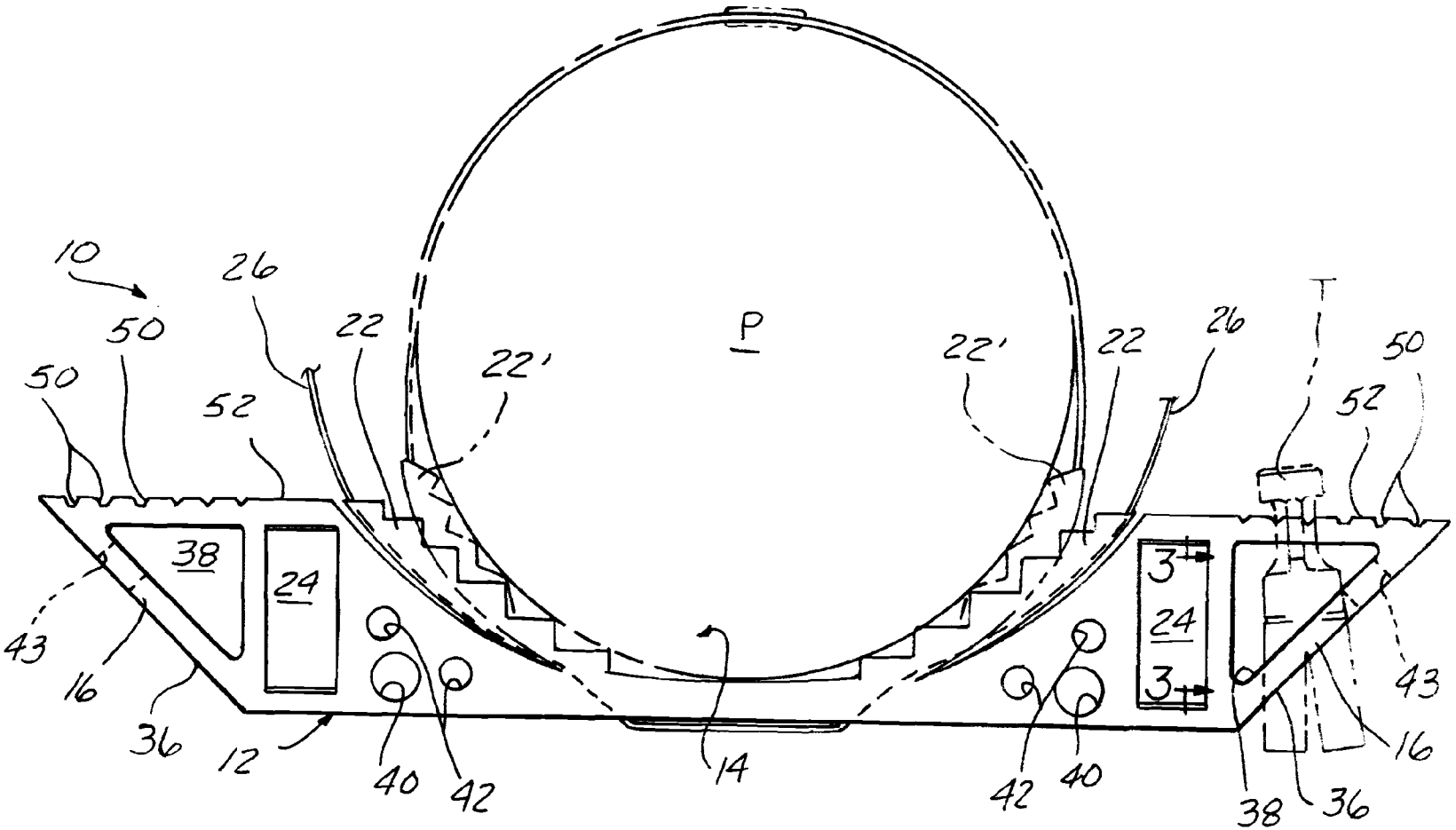
FIG. 2 is a plan view of the ladder attachment shown in FIG. 1.

A pair of arcuate slits 20 extend into the one side of the member 12 and closely spaced out from the outer surface of the cavity 14 and follow its contour to form a pair of opposed curved gripper wing portions 22 integral at one end with the member 12 and concentric to a respective side of the cavity 14. This allows inward movement of each gripper wing portion 22 towards each other by resilient bending of a material at the end of the slits 20. Further bending of the curved wing portions 22 along their lengths allows the achievement of better conformity with the exterior of a utility pole P (FIG. 2) or tree trunk T.

The gripper wing portions 22 are moved towards each other by means of an encircling strap 26 which also holds the wing gripper portions 22 in position when the ends are connected.

Figure 5:
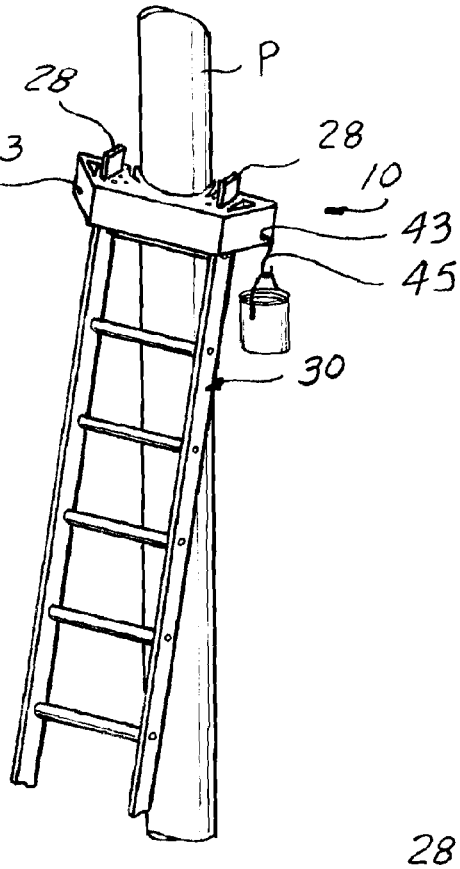
FIG. 5 is a pictorial fragmentary view of a lean ladder and pole with a ladder attachment according to the invention installed on the top of the ladder engaging the pole.
Figure 6:
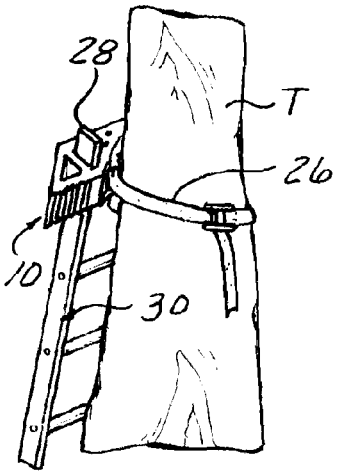
FIG. 6 is a pictorial view from the rear of a lean ladder having a ladder attachment according to the invention installed on the top of the ladder and engaging a tree trunk.
Figure 3:
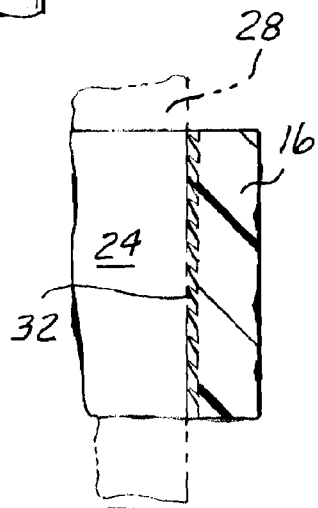
FIG. 3 is a fragmentary view of one end part of the ladder attachment member shown in FIGS. 1 and 2 with portion of a ladder stile installed therein shown in phantom lines.

Each end part 16 is formed with a rectangular hole 24 extending crosswise to the length of the member 12 (generally vertically), which holes 24 are sized and spaced apart so as to be able to receive the upper ends of the stiles 28 of a lean ladder 30 (FIG. 5). The one side of each of holes 24 are preferably formed with angled serrations 32 which project upwardly (FIG. 3) so that once the stiles are inserted from the bottom, pull out is strongly resisted.

Figure 4:
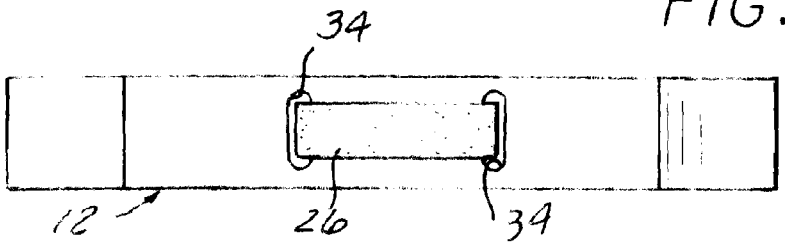
FIG. 4 is a rear elevational view of the ladder attachment shown in FIGS. 1 and 2.

The strap 26 is held on the member 12 by being passed through the slits 20 (a recess 27 accommodating the strap 26) and out through slots 34 and around the rear of the member 12 (FIG. 4). A quick connect cinch 46 (or ratchet mechanism) allows the strap ends to be held in a drawn together position and the cinch 46 allows compression at the outside of the gripper wing portions 22 to grip tightly a pole P or tree trunk T of widely differing diameters and/or uneven contours.

The end parts 16 are each formed with chamfered corners 36 and lightening holes 38 to save weight and material. The holes 38 can also serve as holding receptacles as for tools T, and smaller holes 40, 42 can also be provided for this same purpose. Holes 48 for paint can hooks 45 can also be provided as seen in FIG. 5.

Ridges 50 on the flat outer faces 52 of the end parts 16 increase friction when the ladder 30 is propped against a flat wall (not shown).

The surfaces 52 are located outboard from the ladder stiles 28 and greatly increase frictional engagement with a flat surface to improve stability of the ladder when leaned against a flat surface, resisting sliding, tipping or twisting of the ladder.

The ladder attachment according to the invention has many advantages over the prior devices:

The simple one piece molded member reduces the cost of manufacture.

It also allows for safe use of trees, poles and small diameter pilings as a ladder support.

The preferred elastomeric material also eliminates scratches on support surfaces which the ladder is leaning against such as the paint of aluminum siding or on a transporting vehicle.

The attachment 10 stabilizes a ladder from side to side, even when used against uneven objects or surfaces by the outboard, widely spaced location of the end parts 16.

The ribbed surface 50 allows increased friction against flat support surfaces.

The elastomeric material won't damage trees and allows tightening to grip a pole or tree tightly.

The preferred elastomer material is electrically insulating to prevent electrical shock when contacting a live conductor.

The invention claimed is:

1. A ladder attachment for the stiles of a lean ladder, comprising:

an elongated substantially stiff elastameric member having a concave recess formed recessed into one side thereof of a configuration to be approximately matched to the outside of a rounded upright ladder support, and having integral end parts on either side of said recess;

said end parts each having a hole extending crossways to the length of said member configured to receive an end of a respective stile of said ladder; and said holes spaced from each other a distance substantially corresponding to a spacing of said ladder stiles whereby said member can be readily installed onto the upper ends of said ladder stiles with said integral end parts extending outboard from a respective stile; and, a pair of arcuate slits, each slit extending into said member from a respective of said recess side adjacent a respective end of said member, each slit extending along a respective side of said recess to create a pair of opposed integral flexible gripper wing portions, each portion generally following said respective side of said recess, and a strap engaging said gripper wing portions so as to enable pulling said wing portions by tightening of said strap to enable gripping of said rounded ladder support by said gripper wing portions.

2. A ladder attachment according to claim 1 wherein said recess has a series of vertical steps formed therein for increasing frictional engagement with a pole or tree.

3. A ladder attachment according to claim 2 wherein said holes extend completely through said end parts of said member.

4. A ladder attachment according to claim 1 wherein said steps are tapered out from top to bottom to approximately correspond to an angle of said ladder when propped against a supporting surface.

5. A ladder attachment according to claim 1 and further including a groove on an outer side of each wing portion receiving said strap.

6. A ladder attachment according to claim 1 wherein each of said holes has a wall surface formed with upwardly projecting ridges to retard pull out of said stiles after insertion therein from the bottom.

7. A ladder attachment according to claim 1 further including a slot extending through said member from an end of each slit, said strap passing along said slits and through said slots.

8. A ladder attachment according to claim 1 wherein said strap has respective ends able to be cinched together to pull said gripper wing portions together to grip a rounded support.

9. A ladder attachment according to claim 1 wherein each of said end parts has a flat ribbed surface on said one side of said member able to rest against a flat support surface.

10. A ladder attachment according to claim 1 wherein said member is formed of an electrically non conductive material to prevent shocks when contacting a live conductor.

* * * * *